United States Patent [19]

Mercurio

[11] 4,015,458

[45] Apr. 5, 1977

[54] WAFER TYPE TUMBLER LOCK CONSTRUCTION HAVING INDIVIDUAL SIDE BAR TUMBLER INHIBITING MEANS

[76] Inventor: Leonard Mercurio, 34 Beaumont Drive, Plainview, N.Y. 11803

[22] Filed: Nov. 21, 1975

[21] Appl. No.: 634,156

[52] U.S. Cl. ..... 70/364 R; 70/377; 70/419

[51] Int. Cl.[2] ..... E05B 15/14

[58] Field of Search ..... 70/364 R, 377, 376, 70/416, 419

[56] References Cited

UNITED STATES PATENTS

| | | | |
|---|---|---|---|
| 1,965,889 | 7/1934 | Fitzgerald | 70/419 |
| 2,139,842 | 12/1938 | Miller | 70/364 R |
| 3,722,241 | 3/1973 | Sussina | 70/364 R |

*Primary Examiner*—Robert L. Wolfe
*Attorney, Agent, or Firm*—Charles E. Temko

[57] ABSTRACT

A wafer type tumbler lock construction in which the individual wafer tumblers have a serrated edge for engagement with side bar tumbler inhibiting means actuated when an attempt is made to pick the lock. The side bar means includes a plurality of T-shaped elements, the cross bar portion of which has a serrated edge of length equal to a major portion of the length of the serrated edge on the respective tumbler. The angle of the serrations is such that under normal lock operation, the side bar will be cammed out of engagement with the introduction into the lock cylinder of a correct key.

2 Claims, 6 Drawing Figures

WAFER TYPE TUMBLER LOCK CONSTRUCTION HAVING INDIVIDUAL SIDE BAR TUMBLER INHIBITING MEANS

BACKGROUND OF THE INVENTION

This invention relates generally to the field of tumbler type cylinder locks, and more particularly to a class of such locks in which the tumblers are in the form of flat wafers, and have at least one toothed edge thereof cooperating with similar teeth on a side bar which is fixed against movement parallel to the axis of movement of the tumbler in the lock cylinder. Devices of this type are well known in the art, and the invention lies in specific constructional details permitting markedly lower cost of fabrication, simplification of structure and assembly thereof, as well as substantially foolproof operation.

Typical side bar constructions are illustrated in U.S. Pat. No. 1,600,668 of Sept. 21, 1966 to Winning, and U.S. Pat. No. 1,965,889 to Fitzgerald of July 10, 1934. The former patent discloses a side bar construction which is in entirely fixed relation with respect to the cylinder, and the latter patent discloses a side bar which immobilizes the tumblers until the correct key is inserted in the cylinder. The former construction, while simple, has exhibited doubtful reliability, and the latter construction, while more effective, is not easily fabricated. A more recent improvement is disclosed in U.S. Pat. No. 3,722,241 to Sussina, granted Mar. 27, 1973. This patent discloses a construction employing a side bar brought into action when an attempt is made to rotate the lock cylinder in the absence of a key, a common technique employed when picking the lock. This construction offers engagement of relatively few teeth on the side bar, and relies heavily on the provision of resilient means tending to return each tumbler to locked position when a picking tool is disengaged therefrom.

SUMMARY OF THE INVENTION

Briefly stated, the invention contemplates the provision of an improved side bar construction in a wafer type cylinder lock, in which, instead of employing a single longitudinally oriented side bar capable of engaging all of the tumblers, the function thereof is accomplished by the provision of a plurality of individual elements, one for each tumbler, which may be manufactured as simple metallic stampings. The elements are of generally T-shaped configuration, including a cross member having a toothed edge surface of substantial length overlying a major portion of the length of the individual wafers. By extending the area of contact between the side bar members and the tumblers, the serrations may be made correspondingly small, and may have angularly disposed surfaces permitting a camming action to disengage them from the tumblers upon insertion of the correct key into the cylinder. As a consequence, the lock may be manufactured entirely without springs, and very little torqueing force need be applied in the absence of the key to bring the side bar elements into engagement with the tumblers.

BRIEF DESCRIPTION OF THE DRAWING

In the drawing, to which reference will be made in the specification, similar reference characters have been employed to designate corresponding parts throughout the several views.

DETAILED DESCRIPTION OF THE DISCLOSED EMBODIMENT

Figure 1:
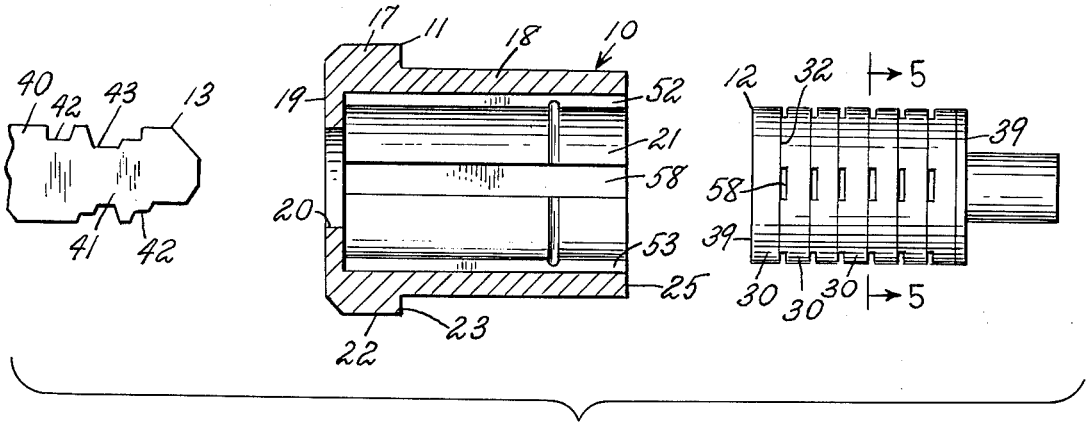
FIG. 1 is an exploded sectional view of an embodiment of the invention.
Figure 2:
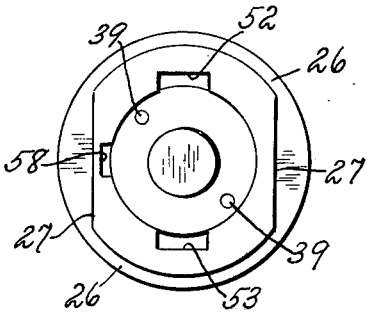
FIG. 2 is an end elevational view of a cylinder element comprising a part of the embodiment.

In accordance with invention, the device, generally indicated by reference character 10, comprises broadly: a housing element 11, a cylinder element 12, a key element 13, tumbler elements 14, and side bar elements 15.

The housing element 11 is of generally conventional configuration, and preferably formed from relatively hard metal. It includes an outer flange member 17, preferably formed integrally with a hollow tubular member 18.

The flange member 17 is bounded by a forward surface 19 defining an opening 20 leading to a cylinder bore 21, as well as an outer cylindrical surface 22 and an inner surface 23 forming a shoulder. The tubular member 18 includes the bore 21 which extends to an end surface 25, a pair of arcuate outer surfaces 26 and a pair of planar surfaces 27. The tubular member 18 is adapted to be inserted in a corresponding opening in a door (not shown) whereby axial rotation is prevented, as is well known in the art.

Figure 3:
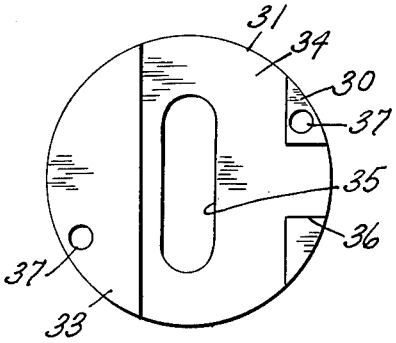
FIG. 3 is an elevational view of one of the segments comprising the cylinder element body.
Figure 4:
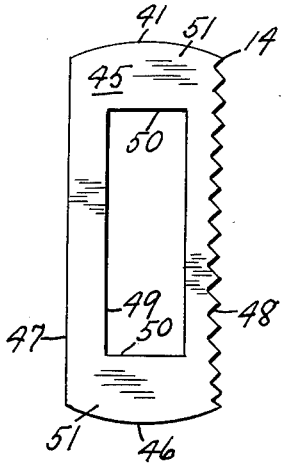
FIG. 4 is an elevational view of an individual wafer tumbler comprising a part of the cylinder element.

The cylinder element 12 includes a plurality of individual cylinder segments 30 which are coaxially aligned. Referring to FIG. 3, each segment is bounded by a cylindrical outer surface 31, a first planar end surface 32 and a second planar end surface 33. Extending into the surface 33 is a centrally disposed transverse channel 34 which slideably accommodates an individual tumbler element 14. Each channel 34 includes an elongated opening 35 permitting passage of the key element 13. A laterally extending channel 36 communicates with the channel 34 and accommodates a portion an individual side bar element 15. A plurality of openings 37 accommodates pin 39 which extend through each of the segments 30 and are headed over at the ends thereof to form an integrated cylinder, this construction being known in the art.

The key element 13 is conventional, including a manually engageable member 40 and a shank member 41 having conventional bittings corresponding in number to the number of tumbler elements 14.

The tumbler elements 14 are preferably formed as stampings from sheet stock to facilitate low cost of production. Each element 14 is bounded by a pair of opposed planar surfaces, one of which is indicated by reference character 45, end edges 46, a smooth side edge 47 and a serrated side edge 48. A central opening 49 includes end edges 50 which engage the bittings 42 of the key element 13 is known manner. Projectable end portions 51 engage one or another of a pair of slots 52–53 extending radially from the bore 21 in the housing element 11 when the device is in locked condition.

The side bar elements 15 are also preferably formed as metallic stampings, each including a laterally extending (with respect to the axis of the cylinder element 12) shank 55, and a cross member 56. The shank 55 is slideably disposed in the channel 36 of an individual cylinder segment 30, and includes a projecting terminal 57 which engages a corresponding slot 58 in the housing element, normally disposed 90° from the slots 52–53. Both the projection 57 and the cross section of the slot 58 are of arcuate configuration, so that the latter may form a camming surface acting against the former when an attempt is made to rotate the cylinder element 12 relative to the housing element 11 in the absence of the key element 13. The cross bar portion 56 includes a pair of smooth coaxially aligned surface 59, and a serrated surface 60 selectively contacting the serrated edge 48 of a respective tumbler element 14.

Figure 6:
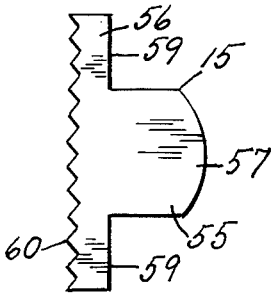
FIG. 6 is a view in elevation of an individual side bar element.
Figure 5:
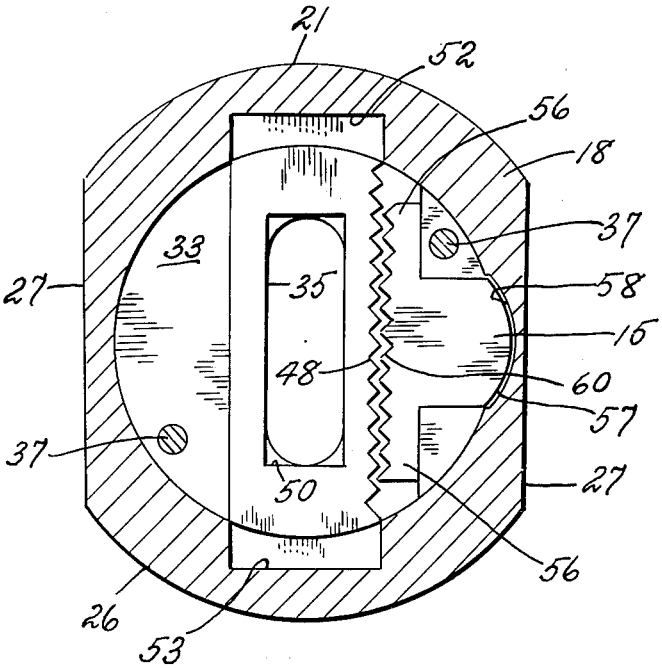
FIG. 5 is a transverse sectional view as seen from the plane 5—5 in FIG. 1.

Operation of the side bar elements 15 will be apparent from a consideration of FIG. 6. During normal operation, with the insertion of the key element 13 into the cylinder element 12, the tumbler element 14 will be laterally moved until they are disposed entirely within the cylinder element, permitting it to be turned within the housing element whereby the projecting shaft 61 may operate an associated latch or other locking means (not shown). When an attempt is made to pick the lock, the usual practice is to apply a light torque to the cylinder element 12 to move the same to an unlocked position. This causes the projecting portions 51 of the tumblers which are disposed in one or the other of the slots 52– 53 in the housing element to abut one side surface of the slots and prevent further rotation of the cylinder element. The movement also causes a camming action to be exerted by the surfaces of the slot 58 upon the end of the shank 55 resulting in the serrated surface 60 engaging the serrated edge 48 of the respective tumbler element, and preventing transverse movement of the latter when a picking tool is inserted in the cylinder element. This action will also occur when the cylinder element 12 is rotated under the influence of the key element 13, but at such time the tumbler elements will be locked with the ends thereof disposed entirely within the cylinder element, so that rotational movement of the cylinder is not impeded.

When the torque applied to the cylinder is released, the subsequent insertion of the key element 13 will align the tumbler elements 14 to correct position for opening the lock. Movement imparted by the key element to the tumbler elements causes the serrations on the tumbler elements to cam those on the side bar elements 15 and return the side bar elements 15 to disengaged condition, this motion being possible by the clearance afforded by the slot 58. Thus, no springs are required for proper action, acting either upon the tumbler elements or the side bar elements.

I wish it to be understood that I do not consider the invention limited to the precise details of structure shown and set forth in this specification, for obvious modifications will occur to those skilled in the art to which the invention pertains.

I claim:

1. In a cylinder type lock including a housing and a cylinder element rotatably disposed within said housing, said cylinder having planar wafer tumblers and side bar means for inhibiting lateral movement of said tumblers relative to the principal axis of said cylinder upon an attempt to pick said lock, the improvement comprising: said housing having a cylindrical bore supporting said cylinder for rotational motion, said bore having at least one elongated groove having an axis parallel to that of said cylinder; said cylinder element including a plurality of generally planar annular segments in mutually stacked relation, elongated pin means penetrating each of said segments for integrating said cylinder elements; each of said segments including a diametrically extending first slot therein, and a second slot radially extending substantially at right angles to and communicating with said second slot; one of said wafer tumblers being disposed in said first slot, each tumbler having a generally centrally disposed key-engaging through opening, and first and second longitudinal edges, at least one of which is serrated; a T-shaped side bar member having an elongated shank portion slideably disposed in said second slot of each of said segments, and a cross bar portion having a serrated edge thereon disposed in said first slot to position said last mentioned serrated edge opposite a serrated edge of a tumbler, said shank portion projecting into a portion of said groove in said housing; whereby upon an attempt to rotate said cylinder element relative to said housing element without a proper key, the surface of said groove serves to cam said shank of said side bar inwardly to bring the serrated edge thereon into contact with the serrated edge on a respective tumbler element and inhibit transverse movement of said tumbler until said cylinder element is returned to its initial condition.

2. Structure in accordance with claim 1, further characterized in said serrations on said tumbler element and said cross bar being of generally triangular shape with the faces thereof disposed at a 45° angle relative to the axis of said shank, whereby the insertion of a key into said tumbler results in transverse movement of said tumblers camming said cross bar out of engagement therewith.

* * * * *